US011402182B2

(12) United States Patent
Ingram et al.

(10) Patent No.: US 11,402,182 B2
(45) Date of Patent: Aug. 2, 2022

(54) FIREWORKS FIRING DEVICE

(71) Applicant: PROFESSIONAL PYROTECHNICS GROUP, LLC, Springfield, MO (US)

(72) Inventors: Michael A. Ingram, Springfield, MO (US); Brandon S. Corn, Springfield, MO (US); Kevin R. Gilfillan, Rocklin, CA (US); Michael H. Ingram, Springfield, MO (US)

(73) Assignee: PROFESSIONAL PYROTECHNICS GROUP, LLC, Springfield, MO (US)

( * ) Notice: Subject to any disclaimer, the term of this patent is extended or adjusted under 35 U.S.C. 154(b) by 20 days.

(21) Appl. No.: 17/018,541

(22) Filed: Sep. 11, 2020

(65) Prior Publication Data

US 2021/0072004 A1 Mar. 11, 2021

Related U.S. Application Data

(60) Provisional application No. 62/912,191, filed on Oct. 8, 2019, provisional application No. 62/898,838, filed on Sep. 11, 2019.

(51) Int. Cl.
*F42B 4/20* (2006.01)

(52) U.S. Cl.
CPC ..... *F42B 4/20* (2013.01)

(58) Field of Classification Search
CPC ..... F42B 4/20; F42B 4/24; F42B 4/30; F42B 4/22; F42B 3/26; B65D 7/00; B65D 11/00; B65D 11/1866; B65D 25/04; B65D 5/48; B65D 90/0066
USPC ..... 102/358
See application file for complete search history.

(56) References Cited

U.S. PATENT DOCUMENTS 4,499,997 A * 2/1985 Swingley, Jr. ..... B65D 81/261 206/427
4,643,306 A * 2/1987 Ryan ..... B07C 7/02 206/509
4,771,695 A 9/1988 Simpson
4,917,015 A 4/1990 Lowery
5,249,528 A 10/1993 Lee
5,282,455 A 2/1994 Adamson et al.
5,312,177 A * 5/1994 Coulter ..... A47B 88/975 403/381
5,415,152 A 5/1995 Adamson et al.
5,567,907 A 10/1996 Westfall
6,244,447 B1 * 6/2001 Frieze ..... A61L 2/26 206/370
6,286,429 B1 9/2001 Marietta et al.
6,393,990 B1 5/2002 Fagan
6,457,415 B1 10/2002 Yan
6,527,122 B1 * 3/2003 Taylor ..... B65D 25/205 206/509

(Continued)

*Primary Examiner* — John Cooper
(74) *Attorney, Agent, or Firm* — Nixon & Vanderhye P.C.

(57) ABSTRACT

A pyrotechnics support apparatus includes a base structure with side walls connected to end walls to define an internal cavity. A tab member extends at an angle from each of the end walls across a width of the end walls. The tab members each include a plurality of slots. A plurality of dividers are selectively connectable to the base structure in the slots in the tab members and between the end walls. The support apparatus provides a sturdy foundation for the safe and precise firing of an array of pyrotechnic devices and is specifically configured to increase efficiency and safety.

17 Claims, 6 Drawing Sheets

(56) References Cited

U.S. PATENT DOCUMENTS

| | | | | |
|---|---|---|---|---|
| 6,851,372 | B2 | 2/2005 | Bender et al. | |
| 7,011,220 | B2 * | 3/2006 | Deye | F42B 4/20 211/60.1 |
| 7,287,474 | B2 | 10/2007 | Whitley | |
| 8,118,157 | B1 | 2/2012 | Piccolin | |
| 8,833,881 | B2 * | 9/2014 | Manniso | A47B 88/90 312/265.5 |
| 9,380,915 | B2 * | 7/2016 | Sabounjian | A47J 31/44 |
| 9,970,738 | B2 | 5/2018 | Garcia Gamon et al. | |
| 2008/0128428 | A1 * | 6/2008 | Beckerman | B65D 25/06 220/532 |
| 2012/0037520 | A1 * | 2/2012 | Cline | A47B 41/00 206/214 |
| 2018/0338617 | A1 * | 11/2018 | Qualkinbush | A47B 88/994 |

* cited by examiner

FIREWORKS FIRING DEVICE

CROSS-REFERENCES TO RELATED APPLICATIONS

This application claims the benefit of U.S. Provisional Patent Application No. 62/898,838, filed Sep. 11, 2019, and U.S. Provisional Patent Application No. 62/912,191, filed Oct. 8, 2019, the entire content of each of which is herein incorporated by reference.

STATEMENT REGARDING FEDERALLY SPONSORED RESEARCH OR DEVELOPMENT (Not Applicable)

BACKGROUND

The invention relates to pyrotechnic devices and, more particularly, to an apparatus for transporting, supporting and firing fireworks devices such as slab cakes/slices, strobes, candles, one-shots, cakes, and other pyrotechnic devices.

Pyrotechnics, or fireworks as they are commonly called, have been used for everything from warding off evil spirits to fighting wars. In the United States, fireworks are used extensively as a way to celebrate America's independence as well as a variety of other noteworthy events. If not handled properly, fireworks devices can be dangerous.

SUMMARY

It would be desirable to provide a pyrotechnics prop that serves to increase safety and efficiency for the pyro-technician.

The pyrotechnics prop of the described embodiments includes a base structure that provides a sturdy foundation for the safe and precise firing of an array of pyrotechnic devices. The design is specifically configured to increase efficiency and safety. In some embodiments, the base structure and components are made from high density polyethylene (HDPE), which gives the structure extreme integrity while remaining light weight. Selectively insertable dividers allow for safe and secure bracing of cakes, slabs and/or other pyrotechnic devices within the base structure. Pyro pegs allow the wiring and electric match to remain more organized and secure prior to, during and after discharge of the pyrotechnic devices. Built-in handles allow for the base structure to be more safely and efficiently carried while being either empty or loaded with pyrotechnic devices.

In an exemplary embodiment, a pyrotechnics support apparatus includes a base structure with side walls connected to end walls to define an internal cavity, and a tab member extending at an angle from each of the end walls across a width of the end walls. The tab members are each provided with a plurality of slots. A plurality of dividers are selectively connectable to the base structure in the slots in the tab members and between the end walls.

Each of the plurality of dividers may include a main body and slot inserts at respective distal ends of the main body, and the slot inserts may be engageable with the slots in the tab members. The main body of the dividers may taper from top to bottom.

The support apparatus may also include handle extensions extending from and continuous with the side walls. The handle extensions have openings therein that define handles for the apparatus. With the plurality of dividers installed in the base structure, the handles may be positioned above a top line of the dividers.

The support apparatus may also include a plurality of pyro pegs extending at an angle from each end of the tab members. The pyro pegs are configured to separate and organize pyrotechnics wiring and an electric match prior to, during and after pyrotechnics discharge. The pyro pegs may be substantially T-shaped. The pyro pegs may be oriented substantially parallel with the end walls of the base structure.

The side walls and the end walls of the base support may be tapered such that the apparatus is nestable with an adjacent support apparatus.

The support apparatus may include a pyro post aperture formed in at least one corner of one of the tab members. In some embodiments, the pyro post apertures may be formed in each corner of the tab members.

The base structure and/or the dividers may be formed of high density polyethylene.

In another exemplary embodiment, a pyrotechnics support apparatus includes a base structure with side walls connected to end walls to define an internal cavity. A tab member, each including a plurality of slots, extends at an angle from each of the end walls across a width of the end walls. A plurality of dividers are selectively connectable to the base structure in the slots in the tab members and between the end walls. Each of the plurality of dividers includes a main body and slot inserts at respective distal ends of the main body, where the slot inserts are engageable with the slots in the tab members. Handle extensions extend from and are continuous with the side walls and include openings therein that define handles for the apparatus. A plurality of T-shaped pyro pegs extend at an angle from each end of the tab members and are oriented substantially parallel with the end walls of the base structure. The pyro pegs are configured to separate and organize pyrotechnics wiring and an electric match prior to, during and after pyrotechnics discharge.

BRIEF DESCRIPTION OF THE DRAWINGS

These and other aspects and advantages will be described in detail with reference to the accompanying drawings, in which.

DETAILED DESCRIPTION

Figure 1:
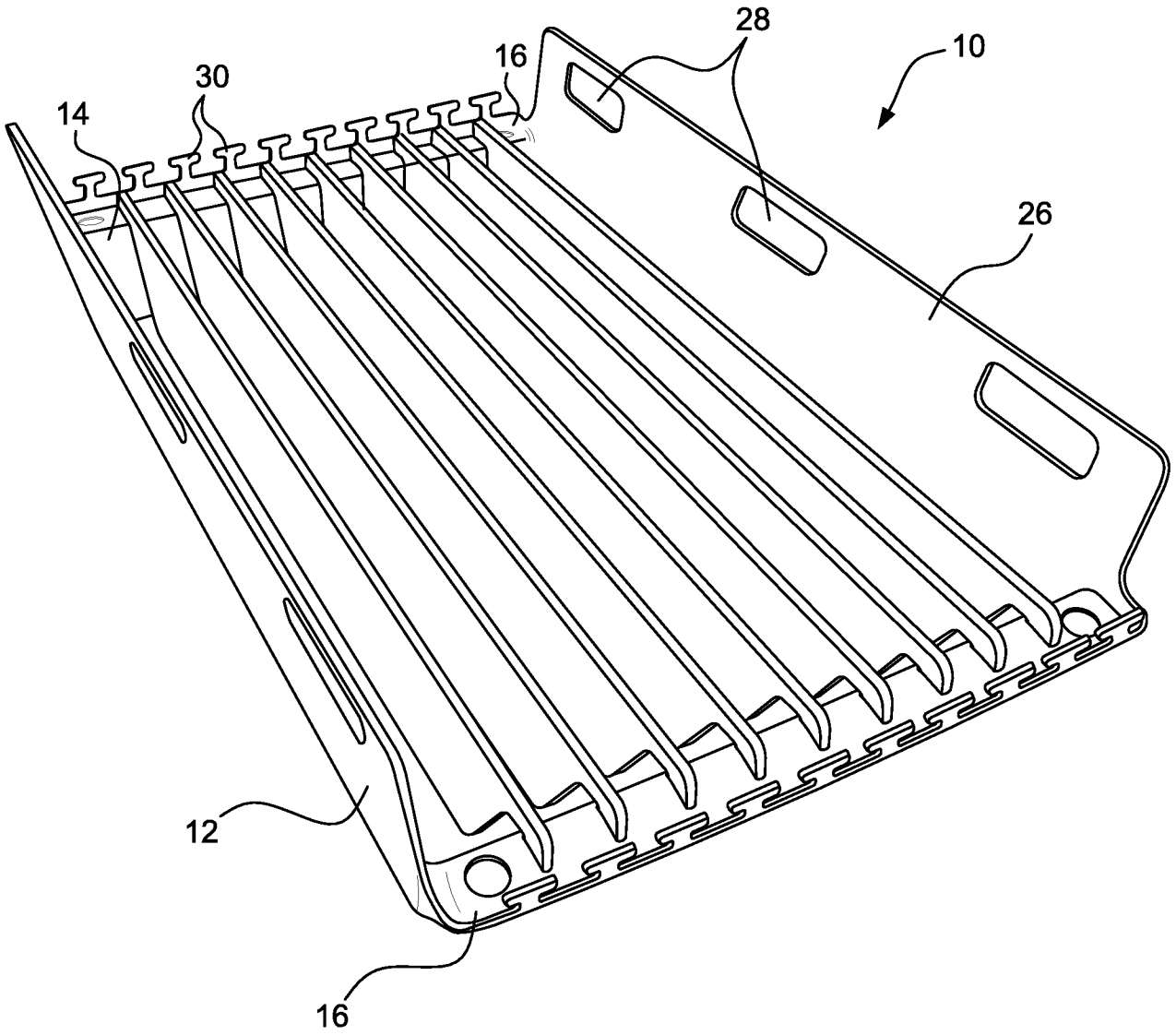
FIG. 1 is a perspective view of the pyrotechnics prop according to the described embodiments.

FIG. 1 is a perspective view of the pyrotechnics support apparatus 10 of the described embodiments. The support apparatus 10 includes a base structure with side walls 12 connected to end walls 14 to define an internal cavity. The base structure provides a sturdy foundation for the safe and precise firing of an array of pyrotechnic devices. A tab member 16 extends at an angle from each of the end walls 14 across a width of the end walls 14 as shown. The tab members 16 are oriented nearly perpendicularly relative to the end walls 14.

Figure 2:
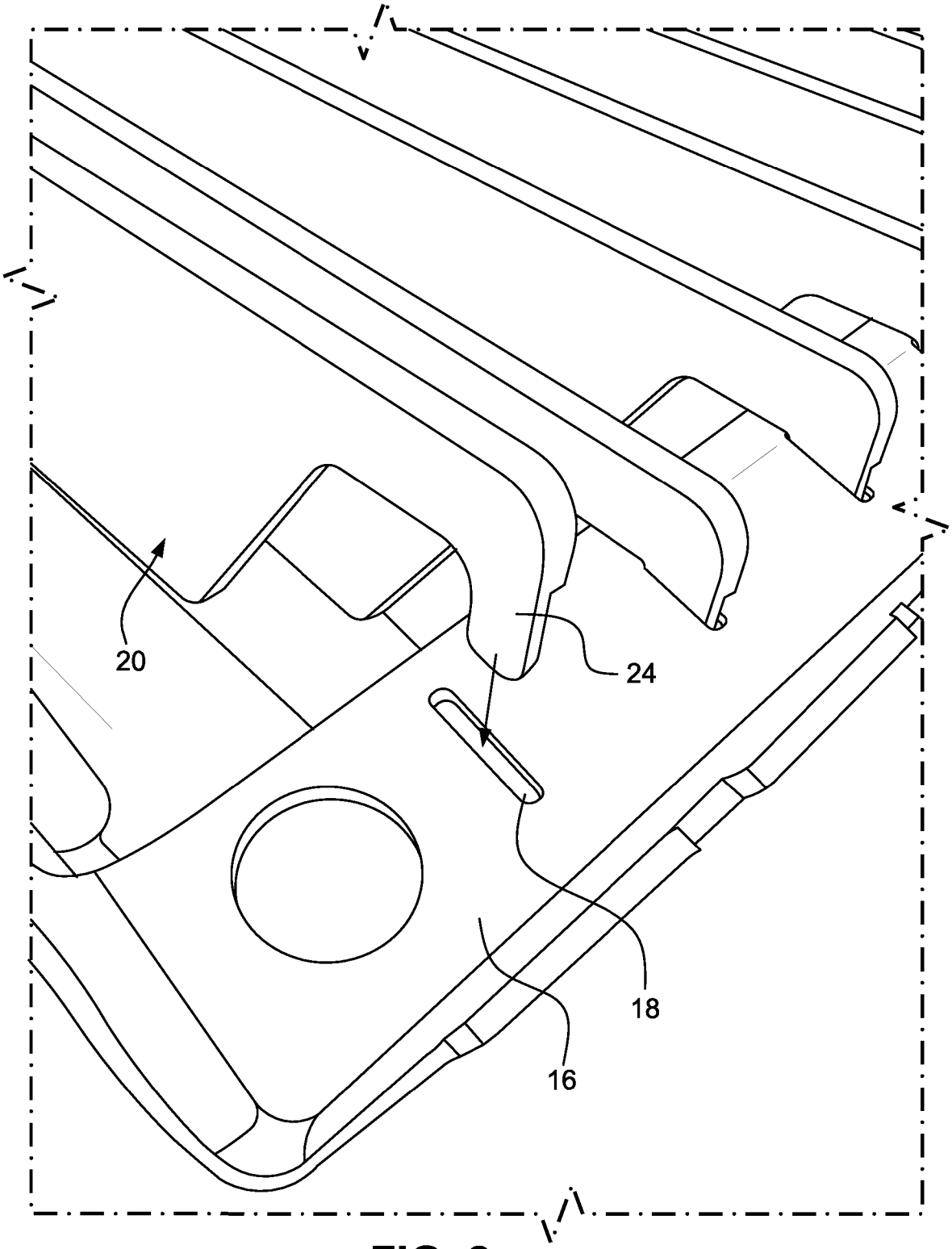
FIGS. 2 and 3 show details of the divider components.

FIG. 2 is a close-up view of one of the tab members 16. Each of the tab members 16 includes a plurality of slots 18, each of which is generally oriented with its longitudinal axis essentially parallel to the side walls 12. The plurality of slots 18 extend across a width of the tab member 16.

Figure 3:
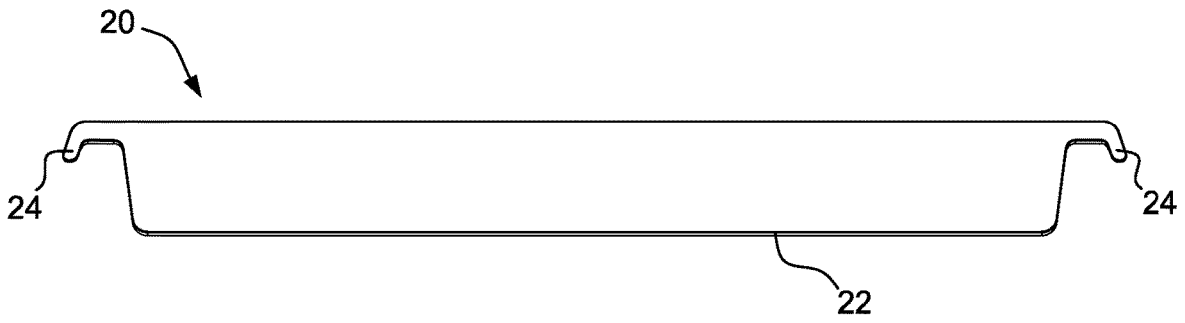
Figure 4:
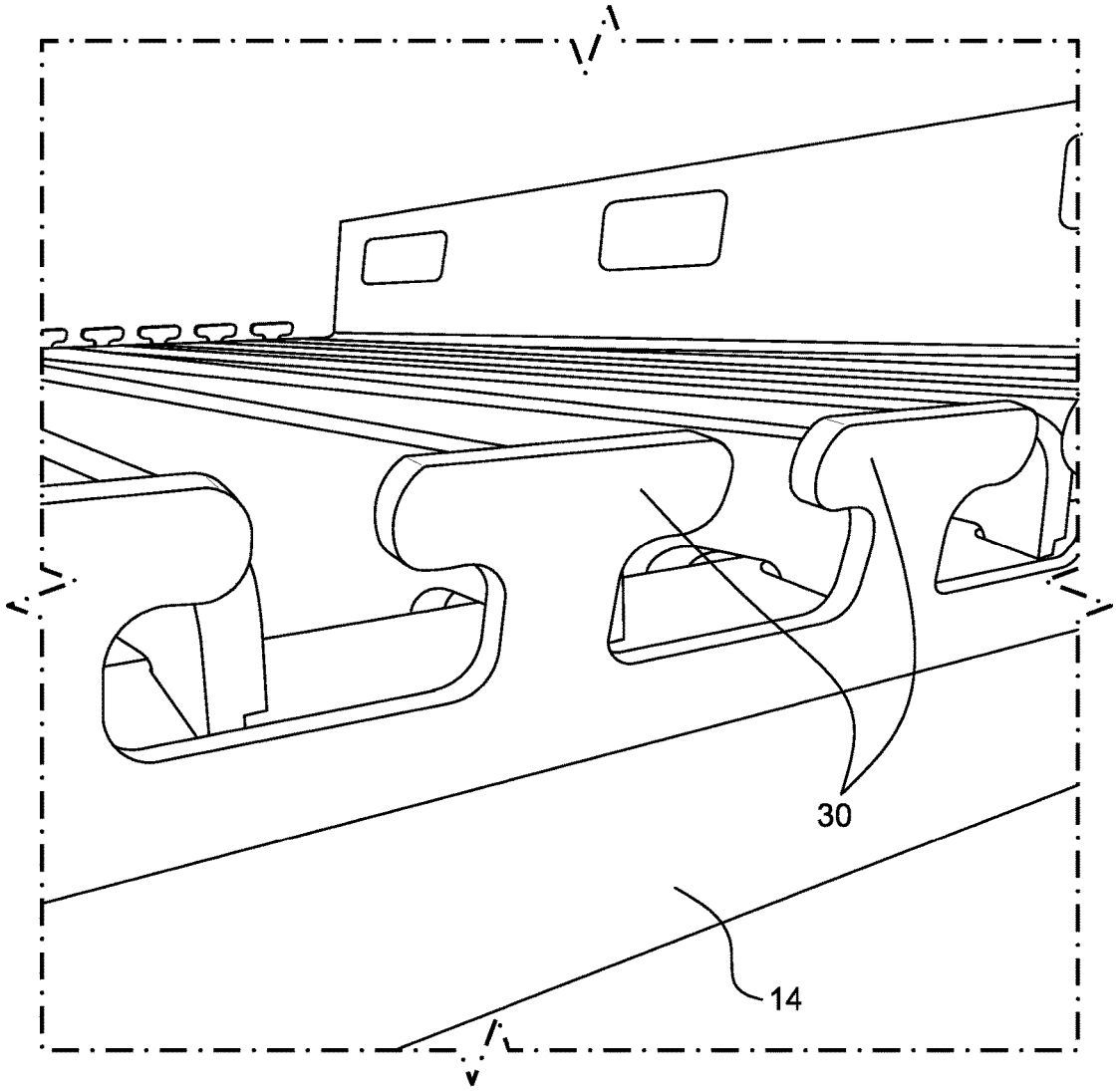
FIG. 4 is a close-up view of the pyro pegs.

With continued reference to FIG. 2 and with reference to FIG. 3, the support apparatus 10 also includes a plurality of dividers 20 selectively connectable to the base structure in the slots 18 between the end walls 14. The dividers 20 allow for safe and secure bracing of cakes, slabs and/or other pyrotechnic devices within the cavity defined by the base structure.

Each of the dividers 20 includes a main body 22 and slot inserts 24 at respective distal ends of the main body 22. The slot inserts 24 are engageable with the slots 18 in the tab members 16. As shown in FIGS. 2 and 3, the main body 22 tapers from top to bottom. The taper facilitates installation of the dividers 20 into the apparatus. In an exemplary construction shown in FIG. 1, each of the tab members 16 includes nine slots 18 configured to receive and support nine separate dividers 20. The base structure could be sized to accommodate more or fewer dividers. Moreover, the spacing between the dividers is specifically configured to accommodate various pyrotechnics devices. The pyro-technician can selectively use all or none of the dividers depending on the selection of pyrotechnic devices.

In some embodiments, the material used for construction of the support apparatus and the described components is high density polyethylene (HDPE), which gives the structure extreme integrity while remaining lightweight.

Figure 5:
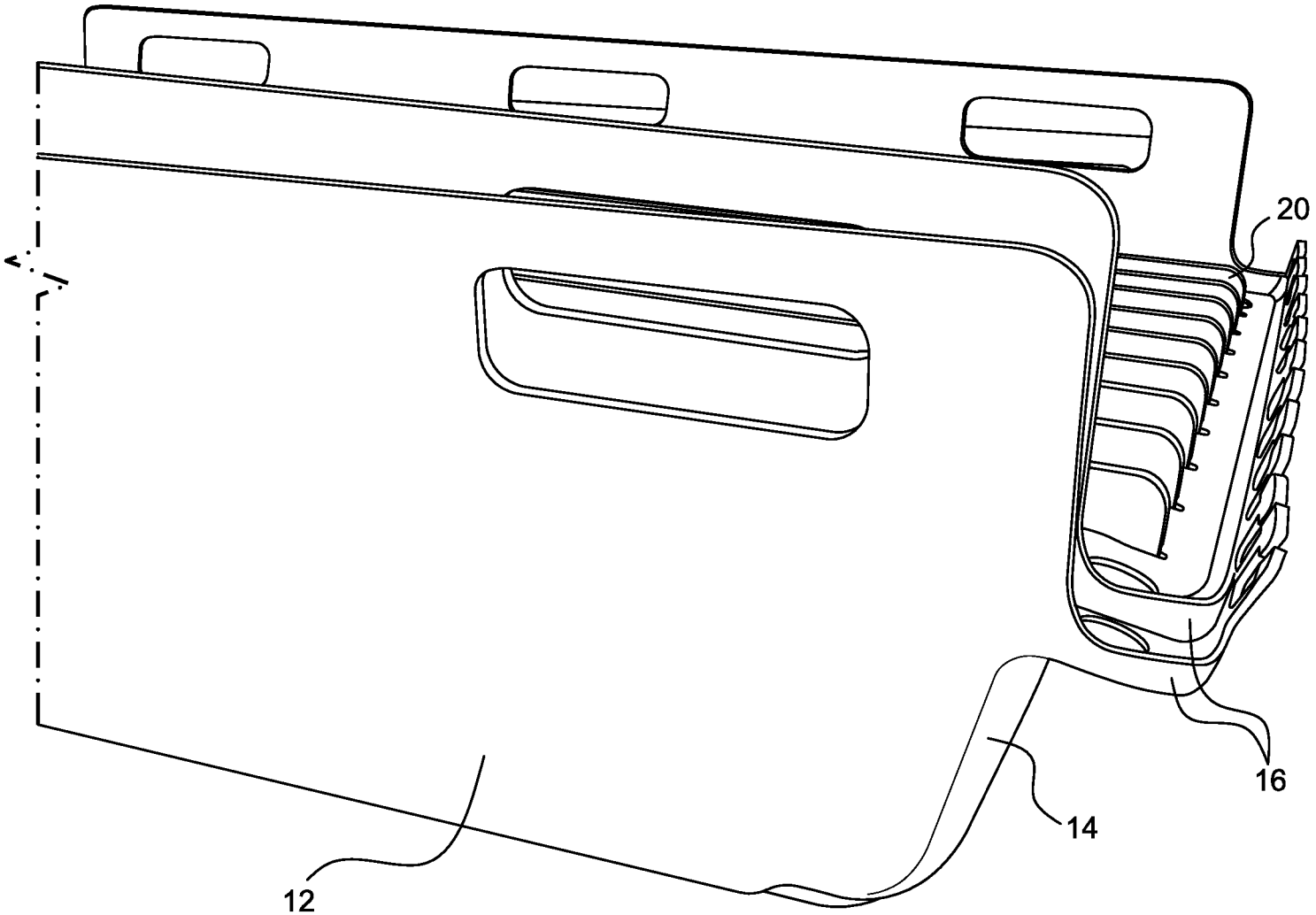
FIGS. 5 and 6 show the pyrotechnics prop in a nested configuration with an adjacent prop.

The apparatus 10 may also include handle extensions 26 extending from and continuous with the side walls 12. The handle extensions 26 include openings therein that define handles 28 for the apparatus. As shown in FIGS. 1 and 5, with the plurality of dividers 20 installed in the base structure, the handles 28 are positioned above a top line of the dividers 20. The handles 28 allow for the apparatus to be more safely and efficiently carried while being either empty or loaded with pyrotechnic devices.

The support apparatus 10 also includes a plurality of pyro pegs 30 extending at an angle from each end of the tab members 16. In some embodiments, as shown, the pyro pegs 30 are essentially T-shaped. The pyro pegs 30 are oriented substantially parallel with the end walls 14 of the base structure. The pyro pegs 30 are configured to separate and organize pyrotechnics wiring and an electric match prior to, during and after discharge of the pyrotechnic device(s). The pyro pegs 30 are designed in such a way that allows pyrotechnic wiring and the electric match to be wrapped around or tied to the pyro pegs 30 to more effectively and securely manage and organize the pyrotechnic wiring and electric match.

Figure 6:
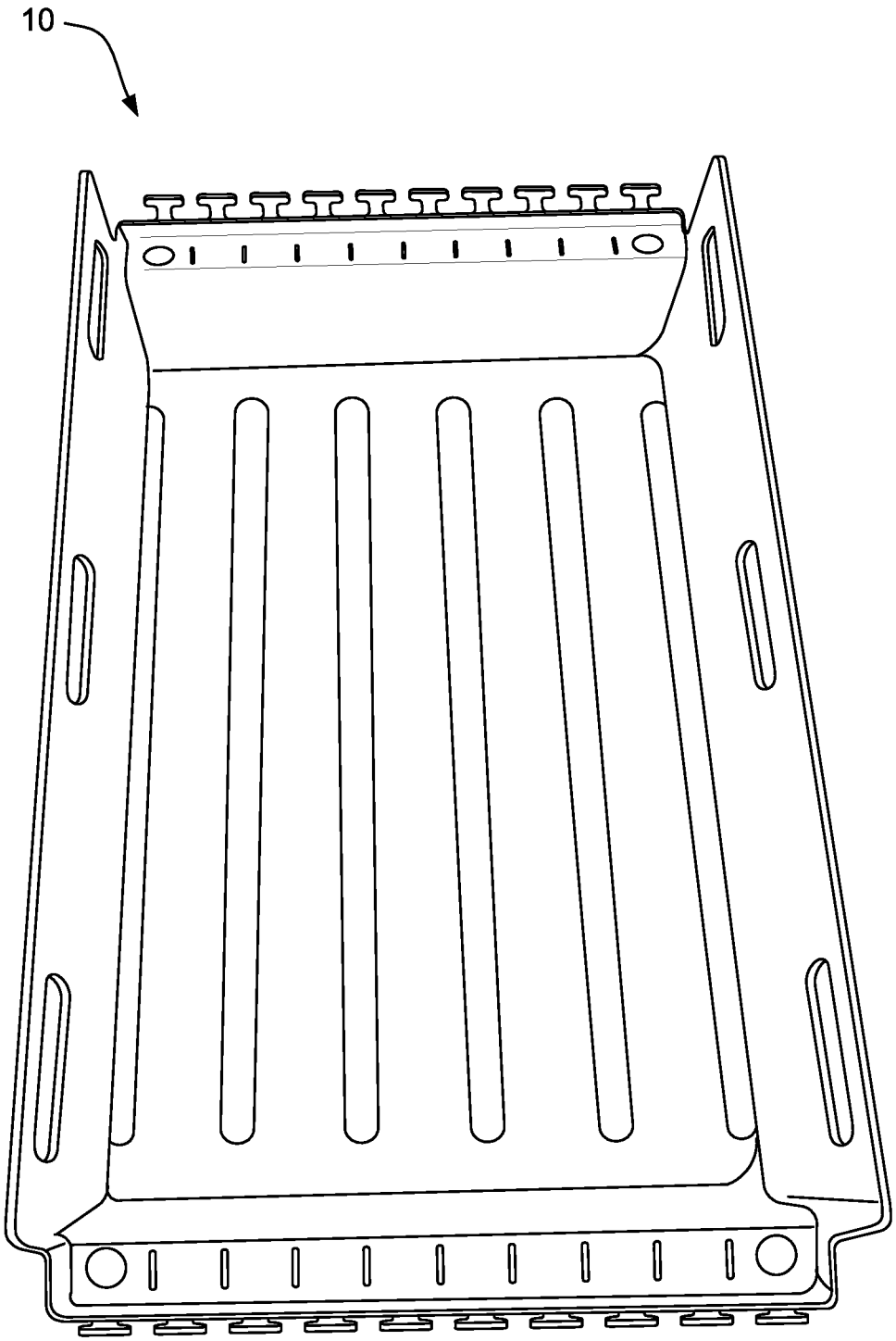

In some embodiments, with reference to FIGS. 5 and 6, the side walls 12 and end walls 14 of the base support are tapered such that the apparatus 10 is nestable with an adjacent support apparatus. FIG. 5 shows a base structure with nine dividers installed nesting with an empty support apparatus. FIG. 6 shows two empty support apparatus in a nested configuration.

Figure 7:
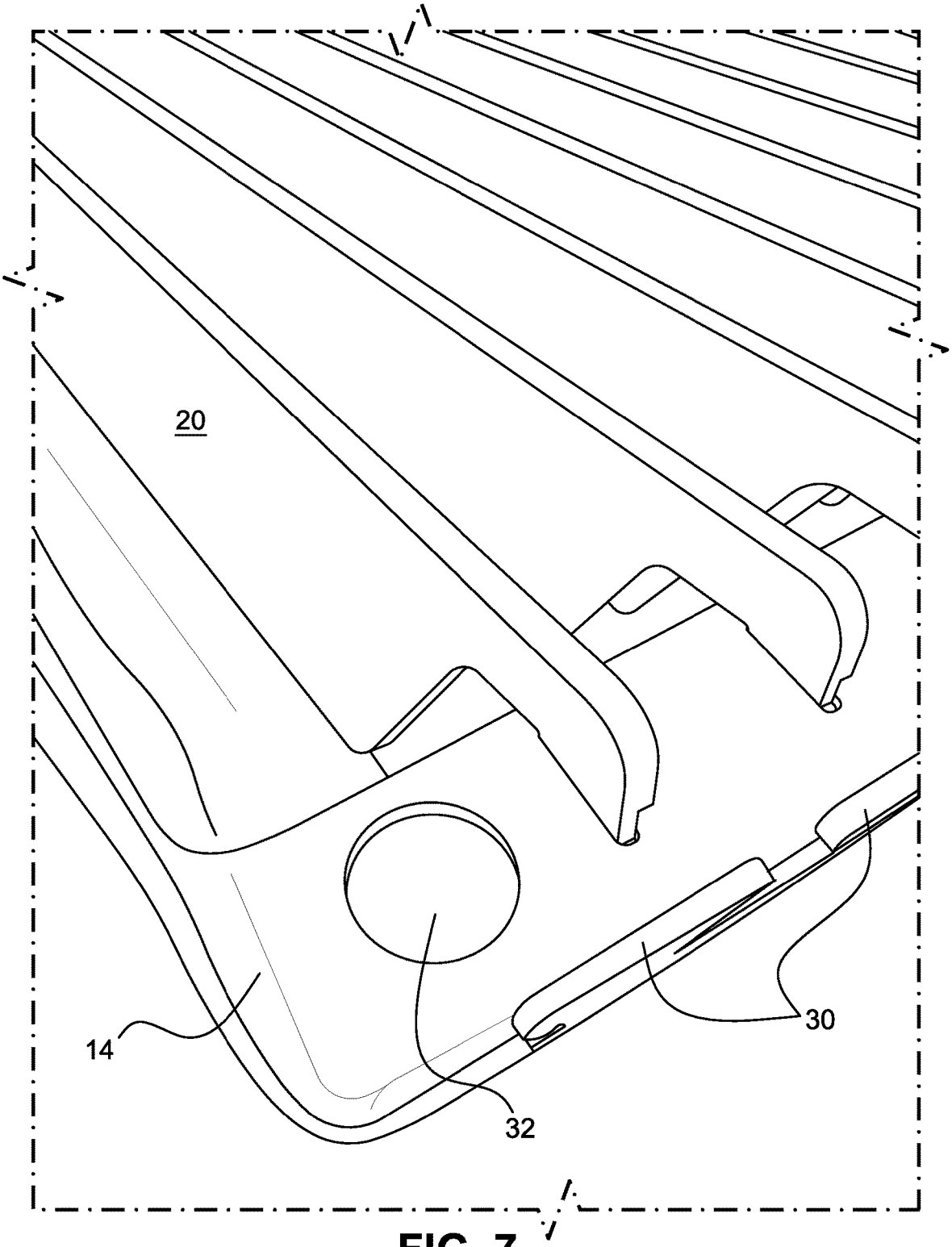
FIG. 7 is a close-up view of a corner aperture for accepting pyro posts.

With reference to FIG. 7, the apparatus may further be provided with one or more pyro post apertures 32 formed in at least one corner of one of the tab members 16. In some embodiments, the pyro post apertures 32 are formed in each corner of the tab members 16. These apertures 32 are configured to accept pyro posts, which can be used in a variety of ways to enhance the functionality of the apparatus. The posts can be used in each of the four corners to stack multiple structures on top of one another for transportation. The posts secured in the apertures 32 create a variable space in between loaded and prepped support apparatus allowing them to be stacked or stored on top of one another. The posts secured in the apertures 32 can also be used to create dynamic firing angles for the support itself on a show site. The posts secured in the apertures 32 allow the support apparatus to be angled at various degrees based upon the length of the posts or how the posts are set in place.

The universal design aspects and components of the described embodiments distinguish the device from existing products. The dividers are designed to be removed and installed depending on the device being fired from the base structure. The use of HDPE provides for integrity while remaining lightweight. The holes at one or more corners of the base structure enable the use of pyro posts to allow display operators to stack loaded and prepped support apparatus for easy deployment.

The support apparatus of the described embodiments provides a universal method to safely discharge multiple devices. The concept and design provides for multiple configurations that can be readily adapted to the needs of pyro-technicians. The material is advantageous in that it allows for lightweight transportation and installation at show sites while remaining extremely durable and UV resistant, which is significant due to the outdoor elements involved with pyrotechnics.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

The invention claimed is:

1. A pyrotechnics support apparatus comprising:

a base structure including side walls connected to end walls to define an internal cavity;

a tab member extending at an angle from each of the end walls across a width of the end walls, the tab members each including a plurality of slots;

a plurality of dividers selectively connectable to the base structure in the slots in the tab members and between the end walls; and a plurality of pyro pegs extending at an angle from each end of the tab members, the pyro pegs being configured to separate and organize pyrotechnics wiring and an electric match prior to, during and after pyrotechnics discharge, wherein the pyro pegs are substantially T-shaped.

2. A pyrotechnics support apparatus according to claim 1, wherein each of the plurality of dividers includes a main body and slot inserts at respective distal ends of the main body, wherein the slot inserts are engageable with the slots in the tab members.

3. A pyrotechnics support apparatus according to claim 2, wherein the main body of the dividers tapers from top to bottom.

4. A pyrotechnics support apparatus according to claim 1, further comprising handle extensions extending from and continuous with the side walls, the handle extensions including openings therein that define handles for the apparatus.

5. A pyrotechnics support apparatus according to claim 4, wherein with the plurality of dividers installed in the base structure, the handles are positioned above a top line of the dividers.

6. A pyrotechnics support apparatus according to claim 1, wherein the pyro pegs are oriented substantially parallel with the end walls of the base structure.

7. A pyrotechnics support apparatus according to claim 1, wherein the side walls and the end walls of the base support are tapered such that the apparatus is nestable with an adjacent support apparatus.

8. A pyrotechnics support apparatus according to claim 1, further comprising a pyro post aperture formed in at least one corner of one of the tab members.

9. A pyrotechnics support apparatus according to claim 8, wherein the pyro post apertures are formed in each corner of the tab members.

10. A pyrotechnics support apparatus according to claim 1, wherein the base structure is formed of high density polyethylene.

11. A pyrotechnics support apparatus according to claim 10, wherein the plurality of dividers are formed of high density polyethylene.

12. A pyrotechnics support apparatus comprising:

a base structure including side walls connected to end walls to define an internal cavity;

a tab member extending at an angle from each of the end walls across a width of the end walls, the tab members each including a plurality of slots;

a plurality of dividers selectively connectable to the base structure in the slots in the tab members and between the end walls, wherein each of the plurality of dividers includes a main body and slot inserts at respective distal ends of the main body, wherein the slot inserts are engageable with the slots in the tab members;

handle extensions extending from and continuous with the side walls, the handle extensions including openings therein that define handles for the apparatus; and a plurality of T-shaped pyro pegs extending at an angle from each end of the tab members and oriented substantially parallel with the end walls of the base structure, the pyro pegs being configured to separate and organize pyrotechnics wiring and an electric match prior to, during and after pyrotechnics discharge.

13. A pyrotechnics support apparatus according to claim 12, wherein the side walls and the end walls of the base support are tapered such that the apparatus is nestable with an adjacent support apparatus.

14. A pyrotechnics support apparatus according to claim 12 further comprising a pyro post aperture formed in at least one corner of one of the tab members.

15. A pyrotechnics support apparatus according to claim 14, wherein the pyro post apertures are formed in each corner of the tab members.

16. A pyrotechnics support apparatus according to claim 12, wherein the base structure is formed of high density polyethylene.

17. A pyrotechnics support apparatus according to claim 16, wherein the plurality of dividers are formed of high density polyethylene.

* * * * *